US008531352B2

(12) United States Patent
Zeng et al.

(10) Patent No.: US 8,531,352 B2
(45) Date of Patent: Sep. 10, 2013

(54) DYNAMIC EDID GENERATION

(75) Inventors: Henry Zeng, Sunnyvale, CA (US); Jing Qian, Shanghai (CN); Xiaoqian Zhang, Shanghai (CN); Xuexin Liu, Shanghai (CN)

(73) Assignee: Synaptics Incorporated, Santa Clara, CA (US)

( * ) Notice: Subject to any disclaimer, the term of this patent is extended or adjusted under 35 U.S.C. 154(b) by 425 days.

(21) Appl. No.: 12/816,202

(22) Filed: Jun. 15, 2010

(65) Prior Publication Data

US 2011/0304522 A1 Dec. 15, 2011

(51) Int. Cl.
*G09G 5/00* (2006.01)

(52) U.S. Cl.
USPC ..... 345/1.3

(58) Field of Classification Search
USPC ..... 345/1.1, 1.3, 3.1–3.4
See application file for complete search history.

(56) References Cited

U.S. PATENT DOCUMENTS

| | | | | |
|---|---|---|---|---|
| 2004/0046707 | A1* | 3/2004 | Mori et al. | 345/1.1 |
| 2004/0080482 | A1 | 4/2004 | Magendanz et al. | |
| 2008/0055189 | A1 | 3/2008 | Wilk et al. | |
| 2009/0307734 | A1 | 12/2009 | Doi et al. | |
| 2011/0047489 | A1* | 2/2011 | Orr et al. | 715/764 |

OTHER PUBLICATIONS

PCT International Search Report and the Written Opinion mailed Oct. 3, 2011, in related International Application No. PCT/US2011/040551.

International Preliminary Report on Patentability and the Written Opinion mailed Jan. 3, 2013, in related International Application No. PCT/US2011/040551.

* cited by examiner

*Primary Examiner* — Allison Walthall
(74) *Attorney, Agent, or Firm* — Haynes and Boone, LLP

(57) ABSTRACT

A multi-monitor display driver that provides consolidated EDID data is provided. The display driver reads the EDID data from the one or more monitors coupled to the driver, determines a consolidated EDID data that is compatible with each of the monitors, and writes the EDID data to an EDID memory in the driver. A source interacting with the driver reads the consolidated EDID data to control interactions with the driver.

16 Claims, 4 Drawing Sheets

DYNAMIC EDID GENERATION

BACKGROUND

1. Technical Field

The present invention is related to a monitor control system and, in particular, a monitor control system that dynamically generates the EDID.

2. Discussion of Related Art

It is becoming more common to utilize multiple monitors. According to a survey by Jon Peddie Research cited in The New York Times, Apr. 20, 2006, it is estimated that use of multiple monitors can increase worker efficiency between 20 to 30 percent. Utilization of multiple monitors can also greatly enhance entertainment such as video gaming or movies.

However, obtaining multiple monitors typically requires multiple video graphics drivers, one for each monitor. Desktop computers, for example, may have multiple graphics cards or a graphics card with multiple drivers on the card. Notebook computers may include a PCMIA cardbus card or such to drive multiple monitors. Further, USB ports may be utilized to drive additional monitors.

However, these options are expensive to implement, require hardware upgrades for addition of each extra monitor, and usually consume large amounts of power. USB ports may also not have enough bandwidth, especially if other devices are also utilizing the port, to provide good resolution to the monitors.

Further, interfaces between video sources and one or more monitors are increasingly difficult with the speed and complexity of the video data being transmitted.

Therefore, there is a need for systems that provide interfaces between a video source and one or more monitors.

SUMMARY

In accordance with some embodiments of the present invention, a multi-monitor driver can include a processor coupled to an EDID memory; at least one monitor interface coupled to the processor; wherein the processor reads EDID data from one or more monitors coupled to the plurality of monitor interfaces, determines a consolidated EDID data based on the EDID data from the one or more monitors, and writes the consolidated EDID data into the EDID memory.

A method of providing EDID data according to some embodiments of the present invention includes reading EDID data from one or more monitors through at least one monitor interface; determining a compatible timing option among the EDID data for the one or more monitors; determining a consolidated timing option based on the compatible timing option; and storing a consolidated EDID data that includes the consolidated timing option in an EDID memory.

These and other embodiments will be described in further detail below with respect to the following figures.

Figure 1:
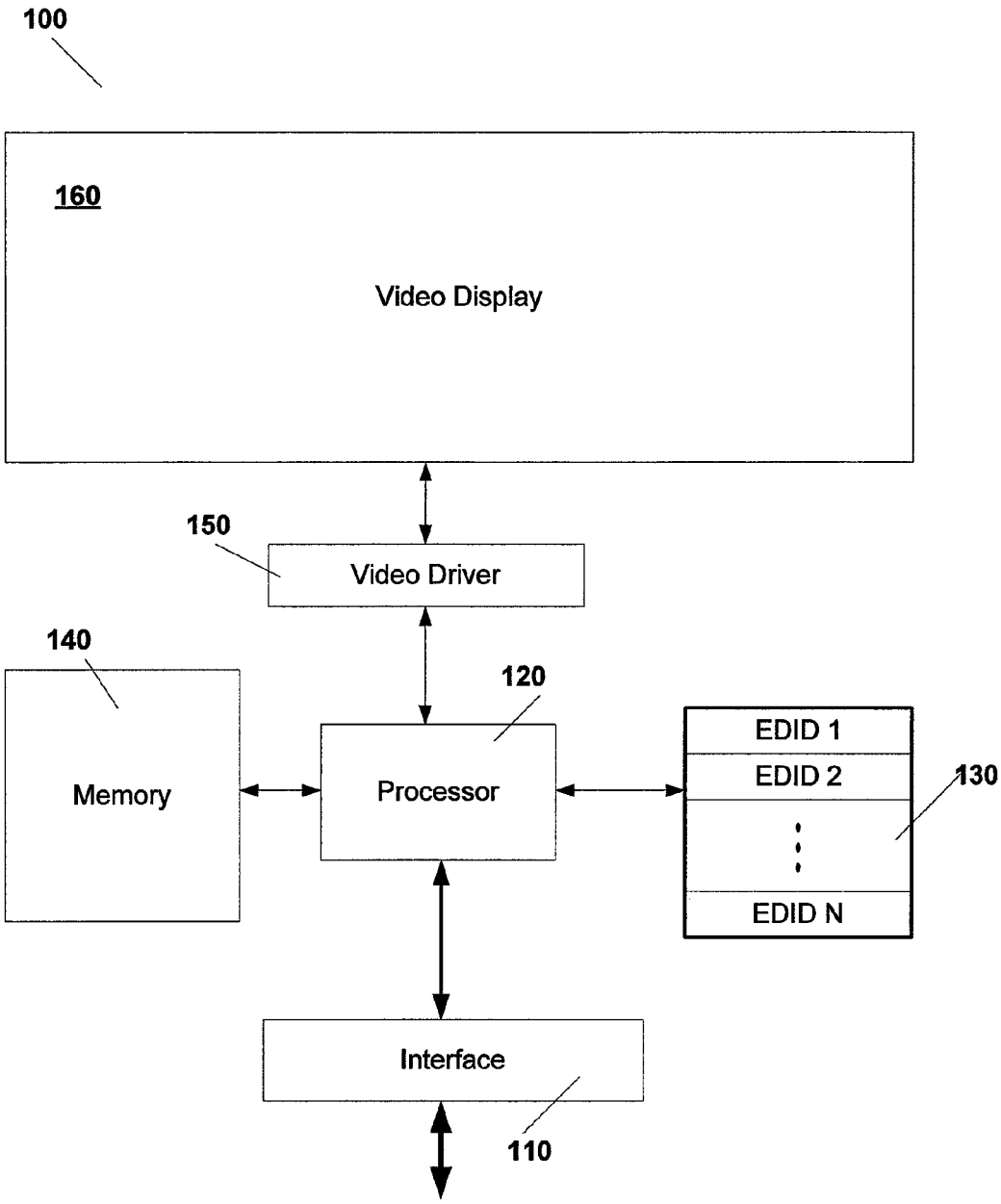
FIG. 1 illustrates a monitor with an EDID memory.

In the drawings, elements having the same designation have the same or similar functions.

DETAILED DESCRIPTION

In the following description specific details are set forth describing certain embodiments of the invention. It will be apparent, however, to one skilled in the art that the present invention may be practiced without some or all of these specific details. The specific embodiments presented are meant to be illustrative of the present invention, but not limiting. One skilled in the art may realize other material that, although not specifically described herein, is within the scope and spirit of this disclosure.

FIG. 1 illustrates a monitor 100 that is typical of many monitors in the market. Monitor 100 includes a video display 160 that is driven by video driver 150. Video driver 150 is controlled by a processor 120. Processor 120 receives control data and video data from an outside source (not shown) through interface 110. Processor 120 also communicates with memory 140 and Extended Display Identification Data (EDID) memory 130. Memory 140 may include both volatile memory such as random access memory for the temporary storage of data and operating parameters and read-only memory such as FLASH or EEPROM for storage of programming instructions. EDID memory 130 is read-only memory that holds EDID data.

EDID data represents a method of defining the capabilities of a monitor such as monitor 100 to a source device. As such, EDID data includes information regarding the horizontal and vertical sizing of monitor 100 as well as defining the supported timing characteristics. Further EDID data can define multiple sets of parameters that are supported by monitor 100, one of which can be chosen by the source through interface 110 to be used for a particular transmission.

For exemplary purposes only, the VESA EDID standard 1.3 will be discussed in some detail. The invention should not be considered to be limited only to this standard. Many modern display devices adhere to the VESA EDID standard, but embodiments of the invention can be utilized with other standards.

The standard for EDID data is set by the Video Electronics Standards Association (VESA), 860 Hillview Court, Suite 150, Milpitas, Calif. 95035. EDID standard 1.3 provides for a 128 byte data field defining the compatible modes of operation of monitor 100. Extended EDID (E-EDID) provides for multiple 128 byte data files defining the compatible modes of operation for monitor 100. In FIG. 1, EDID memory 130 may include multiple separate 128 byte EDID fields EDID 1 through EDID N for holding the modes of operation that are compatible with the operation of monitor 100. In general, EDID memory 130 may include data fields in any format that define the compatible modes of operation of monitor 100.

Table 1 shows the EDID data structure compatible with the VESA standard 1.3. As shown in Table 1, bytes 0-7 are a fixed header set at "00h FFh FFh FFh FFh FFh FFh 00h". Bytes 8-17 provide product information, including manufacturer, serial number, and date of manufacture. Bytes 18-19 provide the EDID standard version and revision ("01h 03h" for version 1.3).

Bytes 20-24 provide basic display parameters, including whether the monitor accepts analog or digital inputs, sync types, maximum horizontal and vertical size, gamma transfer characteristics, power management capabilities, color space, and default video timing. In particular, bit 7 of byte 20 defines whether the input is analog or digital. Bits 5-6 of byte 20 define the video levels ("00"=0.7, 0.3; "01"=0.714, 0.286;

"10"=1, 0.4; and "11"=0.7, 0). Bit 4 of byte 20 indicates a blank-to-black setup when set to 1; bits 1-3 of byte 20 indicate syncing mode (with separate syncs indicated when bit 3 is set, composite sync indicated when bit 2 is set, sync on green set when bit 1 is set. Bit 0 of byte 20 indicates serration vsync or DFP 1.x compatible vsync modes. Byte 21 indicates the maximum horizontal image size in centimeters. Byte 22 indicates the maximum vertical image size in centimeters. Byte 23 indicates the display gamma. Byte 24 indicates power management and support features, with bit 0 indicating whether the default Generalized Timing Formula (GTF) is supported, bit 1 indicating whether the preferred timing mode is provided, bit 2 indicating whether the standard color space is supported, bits 3 and 4 indicating color ("00"=monochrome, "01"=RGB, "10"=non-RGB, and "11"=undefined), bit 5 indicating whether active off/low power is supported, bit 6 indicating whether a suspend state is supported, and bit 7 indicating whether a standby power is supported.

Bytes 25-34 define the RGB color space conversion technique used by the monitor. Byte 25 indicates the low significant bits for Red X (bits 7-6), Red Y (bits 5-4), Green X (bits 3-2), and Green Y (bits 1-0). Byte 26 indicates the low significant bits for Blue X (bits 7-6), Blue Y (bits 5-4), White X (bits 3-2), and White Y (bits 1-0). Bytes 27-34 indicate the high significant bits for Red X, Red Y, Green X, Green Y, Blue X, Blue Y, White X and White Y, respectively. Actual values are between 0.000 and 0.999 with encoded values between 000h and 3FFh.

Bytes 35 and 36 define the VESA-established video resolutions and timings that are supported by the monitor. Each bit represents an established timing. As is typical, a notation of a video resolution and timing (referred to as a timing option), can be designated as H_Active x V_Active @ frame frequency (in Hz). In particular, byte 35 indicates 720×400@70 Hz (bit 7), 720×400@88 Hz (bit 6), 640×480@60 Hz (bit 5), 640×480@72 Hz (bit 4), 640×480@75 Hz (bit 3), 800×600@75 Hz (bit 2), 800×600@56 Hz (bit 1), and 800×600@60 Hz (bit 0). Byte 36 indicates 800×600@72 Hz (bit 7), 800×600@75 Hz (bit 6), 832×624@75 Hz (bit 5), 1024×768@87 Hz (Interlaced) (bit 4), 1024×768@60 Hz (bit 3), 1024×768@70 Hz (bit 2), 1024×768@75 Hz (bit 1), and 1280×1024@75 Hz (bit 0). Byte 37 indicates manufacturer's reserved timing, if any are defined, for example setting bit 7 may indicate an 1152×870@75 Hz timing supported by Apple.

Bytes 38-53 indicate up to eight additional video resolutions that adhere to the VESA defined timings that are supported by the monitor, with each definition being made in two sequential bytes. The first byte indicates the horizontal resolution, which is determined by multiplying the value of the first byte by 8 and adding 248. The second byte indicates the aspect ratio and vertical frequency. Bits 7-6 indicate the aspect ration, with "00"=16:10; "01"=4:3; "10"=5:4; and "11"=16:9. Bits 5-0 indicate the vertical frequency, with the actual vertical frequency determined by addition 60 to the value.

Bytes 54-125 are organized into four 18-byte blocks that describe additional video resolutions in detail so that custom video timings and resolutions can be supported. The first 18-byte block can be utilized to describe the preferred video timing for the monitor. Timing data can be structured according to the VESA Generalized Timing Formula. Using Descriptor Block 1, bytes 54-71, as an example, the pixel clock is provided in bytes 54 and 55 with byte 55 providing the most-significant bits and byte 54 providing the least significant bits. If the pixel clock provided in bytes 54-55 are non-null, then byte 56 provides the horizontal active pixels LSB, byte 57 provides the horizontal blanking in pixels LSB, byte 58 in the 4 upper bits provides the horizontal active pixels MSB and the 4 lower bits provide the horizontal blanking MSB. Similarly, byte 59 provides the LSB vertical active lines, byte 60 provides the LSB vertical blanking while byte 61 in the four upper bits provides the MSB of the vertical active lines and the four lower bits provide the MSB of the vertical blanking. Byte 62 provides the LSB of the horizontal sync offset in pixels. Byte 63 provides the LSB of the horizontal sync pulse width in pixels. Byte 64 provides the LSB of the vertical sync offset in the four upper bits and the LSB of the vertical sync pulse width in the four lower bits. Byte 65 provides the MSB of the horizontal sync offset in bits 7-6, the MSB of the horizontal sync pulse width in bits 5-4, the MSB of the vertical sync offset in bits 3-2, and the MSB of the vertical sync pulse width in bits 1-0. The LSB of the horizontal image size in millimeters is provided in byte 66 while the LSB of the vertical image size in millimeters is provided in byte 67. Byte 68 provides the MSB of the horizontal image size in the four upper bits and the MSB of the vertical image size in the four lower bits. Byte 69 provides the horizontal border in pixels. Byte 70 provides the vertical border in lines. Byte 71 provides parameter information: interlaced or not in bit 7, stereo or not in bits 6-5, separate sync or not in bits 4-3, vertical sync positive or not in bit 2, horizontal sync positive in not in bit 1, stereo mode in bit 0.

If the pixel clock designated in bytes 54-55 are 0, then the designations for bytes 56-71 are different. In that case, byte 56 is set to 0. Byte 57 indicates the block type: "FFh"=monitor serial number, "FEh"=ASCII string, "FDh"=Monitor Range Limits, "FCh"=Monitor name, "FBh"=color point data, "FAh"=standard timing data, "F9h"=undefined, and "0Fh"=manufacturer defined. Byte 58 is set to 0. If the block type is "FFh", "FEh", or FCh", then blocks 59-71 holds a text string. If the block type is "FDh" then bytes 59-63 hold the minimum vertical frequency, maximum vertical frequency, minimum horizontal frequency, maximum horizontal frequency, and the pixel clock; bytes 64-65 provide a secondary GTF toggle indicating which of bytes 59-63 or bytes 67-71 to utilize for timing information; byte 66 provides a start horizontal frequency in kHz; byte 67 provides the value C; bytes 68-69 provides the value M with the LSB stored in byte 68; byte 70 provides the value K; and byte 71 provides the value J. The parameters C, M, K, and J refer to parameters in a secondary timing curve that is utilized to specify some timing optionsIf the block type is "FBh," then bytes 59-71 are utilized for color data. Byte 59 indicates W index 0 and, if set to 0, then bytes 60-63 are unused but if set to 1, then bytes 61-63 are assigned to a white point index #1. Similarly, byte 64 also represents W index 1 and, if set to 0, then bytes 65-68 are unused and if set to 2, then bytes 65-68 are assigned to white point index #2. The white point index structure is as follows: First byte, bits 3-2 are the LSB of White X and bits 1-0 are the LSB of White Y; the Second to Third bytes are the MSB significant bits of White X and White Y; the Fourth byte indicates Gamma.

If the block type is "FAh", then bytes 59-70 indicate standard timing identification with two bytes for each record as is indicated with bytes 38-53 above. Descriptor blocks 2, 3, and 4, corresponding to bytes 72-89, 90-107, and 108-125, respectively, follow the same format as described above for descriptor block 1 in bytes 54-71.

Byte 126 is an extension flag and is utilized to indicate how many additional 128 byte EDID records follow the current data. Byte 127 is a Checksum byte and is set such that the sum of all 128 bytes in the EDID data is summed to "00h".

Extension data, for example EDID 2 through EDID M shown in EDID data 130 in FIG. 1, may, for example, adhere to the CEA EDID Timing Extension Version 3 data format. In accordance with the CEA EDID timing extension, byte 00 is an extension flag where "02h" indicates the CEA EDID standard. Byte 01 indicates the revision number, currently "03h" for Version 3. Byte 02 identifies the byte number for the start of the 18 byte detailed timing descriptor (DTD) blocks, which are coded in the format discussed above. If byte 02 is "00h", then the extension block includes no DTD data. Byte 3 includes further parameter data: bit 7 indicates whether or not the monitor supports underscan; bit 6 indicates whether or not the monitor supports basic audio; bit 5 is set if the monitor supports YCbCr 4:4:4 formatted data; bit 4 is set if the monitor supports YCbCr 4:2:2 formatted data; bits 3:0 indicate the total number of DTD blocks included in the current EDID data block.

If byte 2 is set to "04h", then 18 byte DTD blocks start with byte 04. The format for the 18 byte blocks is discussed above with respect to bytes 54-71 of the first EDID data block discussed above.

If byte 2 is not set to "04h", then byte 04 starts a data block collection that includes one or more data blocks detailing video, audio, and speaker placement information about the monitor. The blocks can be placed in any order, and the initial byte of each block defines both its type and its length. Data collection blocks continue until the block designated by byte 2, which begins the 18 byte DTD blocks, or until all of the data collection blocks are included. The first byte in each data collection block, therefore, is arranged as follows: Bits 7:5 defines the block type tag (1 for audio, 2 for video, 3 is vendor specific, 4 is for speaker allocation); and Bits 4:0 provides the total number of bytes in the block following the first byte. Once one data block has ended, the next byte is assumed to be the beginning of the next data block.

An audio data block contains one or more 3-byte short audio descriptors (SADs). Each SAD details audio format, channel number, and bitrate/resolution capabilities of the display. SAD byte 1 defines the format and number of channels. Bit 7 of SAD byte 1 is reserved (0) while bits 6:3 of SAD byte 1 indicate the audio format code as follows: 1=Linear Pulse Code Modulation (LPCM); 2=AC-3; 3=MPEG1 (layers 1 and 2); 4=MP3; 5=MPEG2; 6=AAC; 7=DTS; 8=ATRAC; 9=One-bit audio aka SACD; 10=DD+; 11=DTS-HD; 12=MLP/Dolby True HD; 13=DST Audio; and 14=Microsoft SMA Pro. Bits 2:0 indicate the number of channels minus 1 (i.e. "000h"=1 channel and "111h" is eight channels).

SAD Byte 2 indicates the supported sampling frequencies (bit 7 is reserved; bit 6 indicates 192 kHz; bit 5 indicates 176 kHz; bit 4 indicates 96 kHz; bit 3 indicates 88 kHz; bit 2 indicates 48 kHz; bit 1 indicates 44 kHz; and bit 0 indicates 32 kHz). SAD Byte 3 indicates the bit rate. For LPCM, bits 7:3 of byte 3 are reserved; bit 2 indicates 24 bit; bit 1 indicates 20 bit; and bit 0 indicates 16 bit. For other formats, bits 7:0 designate the maximum supported bitrate divided by 8 kHz.

A Video Data Block includes one or more 1-byte short video descriptors (SVDs). Bit 7 of the SVD byte being 1 designates that the SVD should be considered a "native" resolution and bit 7 being 0 indicating non-native resolutions. Bits 6:0 of SVD 1 is an index value to a table of standard resolutions and timings defined by CEA/EIE-861E as indicated in Table 2

Designations for the values 0 and 64-127 are reserved. Additionally, short video descriptors 20 and 39 differ in the number of vertical total lines, which are 1125 and 1250, respectively. In Table 2, parentheses indicate where pixels are repeated to meet the minimum speed requirements of the interface. In designations 10 and 11 ((2880)X480i), the number of pixels on each line, and thus the number of times that those pixels are repeated, is variable, and is sent to the monitor by the source device. Increased Hactive expressions include "2×" and "4×" indicate two and four times the reference resolution, respectively.

Table 2 illustrates the CEA/EIA-861/E VESA standard. CEA/EIA-861/A standard includes only designations 1-7 and designations 17-22 above, which are considered primary video format timings. Short video descriptors as defined in Table 2 where introduced in CEA/EIA-861B. The CEA/EIA-861B also defined designations 8-16 and 23-34 so that it included the first 34 short video descriptors described in Table 2. The CEA/EIA-861D standard included the first 59 short video descriptors above. HDMI 1.0 to HDMI 1.2a uses the CEA-861-B video standard, HDMI 1.3 to HDMI 1.3c uses the CEA-861-D video standard, and HDMI 1.4 uses the CEA/EIA-861E video standard.

A Vendor Specific Data Block contains as its first three bytes the vendor's IEEE 24-bit registration number, LSB first. For example, with HDMI vendors, the first three bytes contain "00h 0Ch 03h" for HDMI Licensing, LLC. The next two bytes provide a source physical address, LSB first, which provides the CEC physical address for upstream CEC devices. It is followed by a two byte source physical address, LSB first. The source physical address provides the CEC physical address for upstream CEC devices. The remainder of the Vendor Specific Data Block is the "data payload", which can be anything the vendor considers worthy of inclusion in this EDID extension block.

If a Speaker Allocation Data Block is present, it will consist of three bytes. The second and third are Reserved (all 0), but the first byte contains information about which speakers are present in the display device: bit 7 is Reserved (0); bit 6 indicates the presence of rear left center and rear right center speakers; bit 5 indicates the presence of front left center and front right center speakers; bit 4 indicates the presence of rear center speaker; bit 3 indicates the presence of rear left and rear right speakers; bit 2 indicates the presence of a front center present speaker; bit 1 indicates the presence of LFE; and bit 0 indicates the presence of front left and front right speakers.

At the completion of all block of data, the extension block is padded with "00h" until byte 126. In each block, bytes 126 and 127 are as defined above with the first EDID block.

Although on particular EDID data structure was discussed in some detail above, embodiments of the present invention can operate with any formatted EDID data. As such, the present invention is not limited to operation with the VESA EDID standard discussed above. Instead, embodiments of the present invention may operate with any EDID data.

Figure 2:
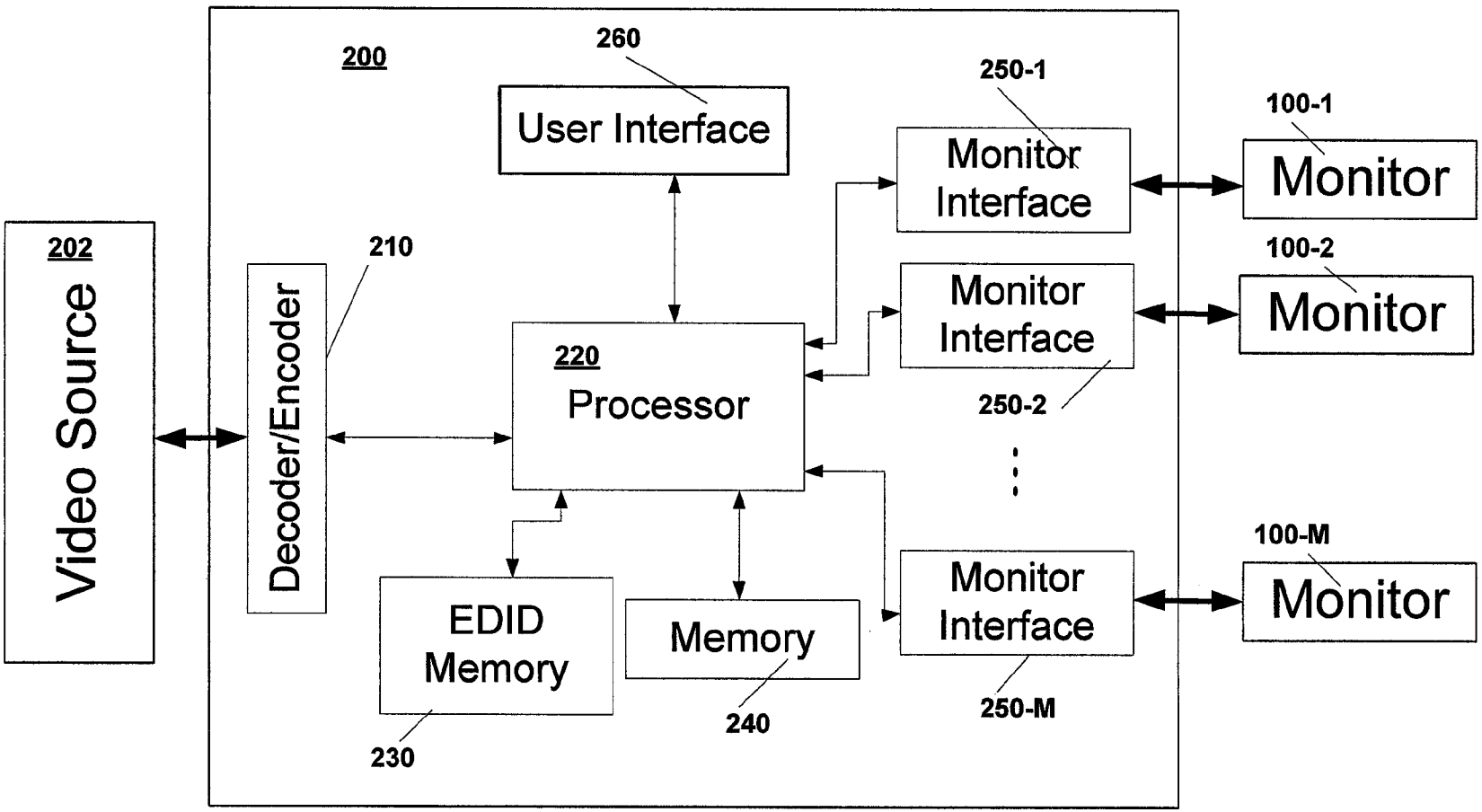
FIG. 2 illustrates a driver according to some embodiments of the present invention.

FIG. 2 illustrates a driver 200 according to some embodiments of the present invention. Driver 200 communicates with an outside source 202 through interface 210, which provides signals to processor 220. Embodiments of interface 210 can communicate with any outside source 202. In some embodiments, the outside source 202 and driver 200 are compatible with the DisplayPort standard (the "DP standard"). The VESA DisplayPort Standard, Version 1, Revision 1a, released Jan. 11, 2008, which is available from the Video Electronics Standard Association (VESA), 860 Hillview Court, Suite 150, Milpitas, Calif. 95035, is herein incorporated by reference in its entirety. In accordance with the DisplayPort standard, data is transmitted between the source and interface 210 through three data links: a main link, an auxiliary channel, and a hot plug detect. Main link may include 1, 2, or 4 data lanes.

The DP standard currently provides for up to 10.8 Gbps (giga bits per second) through main link, which may support greater than QXGA (2048×1536) pixel formats, and greater than 24 bit color depths. Further, the DP standard currently provides for variable color depth transmissions of 6, 8, 10, 12, or 16 bits per component. In accordance with the DP standard, bi-directional auxiliary channel provides for up to 1 Mbps (mega bit per second) with a maximum latency of 500 microseconds. Furthermore, a hot-plug detection channel is provided. The DP standard provides for a minimum transmission of 1080p lines at 24 bpp at 50/60 Hz over 4 lanes at 15 meters.

Additionally, the DP standard supports reading of the extended display identification data (EDID) whenever the hot plug detecting channel indicates to the outside sink is connected. Further, the DP standard supports display data channel/command interface (DDC/CI) and monitor command and controls set (MMCS) command transmission. Further, the DP standard supports configurations that do not include scaling, a discrete display controller, or on screen display (OSD) functions.

The DP standard supports various audio and visual content standards. For example, the DP standard supports the feature sets defined in CEA-861-C for transmission of high quality uncompressed audio-video content, and CEA-931-B for the transport of remote control commands between a sink, such as multi-monitor driver 200, and an outside source. Although support of audio aspects is not important to embodiments of the present invention, the DP standard supports up to eight channels of linear pulse code modulation (LPCM) audio at 192 kHz with a 24 bit sample size. The DP standard also supports variable video formats based on flexible aspect, pixel format, and refresh rate combinations based on the VESA DMT and CVT timing standards and those timing modes listed in the CEA-861-C standard. Further, the DP standard supports industry standard colorimetry specifications for consumer electronics devices, including RGB and YCbCr 4:2:2 and YCbCr 4:4:4.

Processor 220 provides data for presentation on one or more multiple monitors through monitor interfaces 250-1 through 250-M, where M can be any integer greater than or equal to one. Monitor interfaces 250-1 through 250-M each act as individual sources to the monitors coupled to them, monitors 100-1 through 100-M, respectively. As indicated in FIG. 2, each of monitor interfaces 250-1 through 250-M is coupled to a corresponding one of monitors 100-1 trough 100-M. Each of mMonitors 100-1 through 100-M can be similar to monitor 100 as shown in FIG. 1, but each may have different EDID characteristics as indicated in the EDID memories of each of the monitors. Processor 220 can read the EDID data from each of monitors 100-1 through 100-M through monitor interface 250-1-monitor interface 250-M.

Processor 220 is further coupled to an EDID memory 230 and a memory 240. Memory 240 can include both RAM and ROM memories. Programming instructions and operating parameters, for example, may be stored in ROM memory. EDID memory 230, which may be combined with the RAM portion of memory 240, holds the EDID data that is provided to an outside video source 202 by processor 220 through decoder/encoder 210. In some embodiments, the EDID data produced by processor 220 is consolidated data considering the EDID data from each of monitors 100-1 through 100-M and follows the VESA EDID convention as discussed above. However, other conventions can be utilized.

Whenever monitor driver 200 is started, or in some cases whenever a new one of monitors 100-1 through 100-M is plugged into driver 200, processor 220 receives the EDID identifications from each of monitors 100-1 through 100-M through interfaces 250-1 through 250-M, respectively, and generates consolidated EDID data for storage in EDID memory 230. Video source 202 reads the EDID information stored in EDID memory 230 through decoder/encoder 210.

The EDID data stored in EDID memory 230 provides source 202 with the operating parameters for a conglomerate of monitors 100-1 through 100-M. For example, the horizontal and vertical dimensions presented to the source represents the overall physical dimensions spanned by the monitors attached to monitor interfaces 250-1 through 250-M. As such, to source 202, driver 200 appears to be a video sink of the consolidated dimensions and video timing characteristics stored in EDID memory 230. Further, to each of monitors 100-1 through 100-M, driver 200 appears as a source providing video data at dimensions and video timing characteristics compatible with each individual monitor. Splitting DisplayPort compatible video data for distribution across multiple monitors is described, for example, in U.S. patent application Ser. No. 12/353,132, filed on Jan. 13, 2009; U.S. patent application Ser. No. 12/755,253, filed on Apr. 6, 2010; U.S. patent application Ser. No. 12/634,571, filed on Dec. 9, 2009; Taiwanese Application No. 99100666, filed Jan. 12, 2010, each of which is incorporated herein by reference in its entirety. As discussed above, driver 200 may communicate with source 202 utilizing any standard and may communicate with monitors 100-1 through 100-M using any standard. One such standard is the DisplayPort standard discussed above.

Monitors 100-1 through 100-M, attached to monitor interfaces 250-1 through 250-M, may be arranged in any way. For example, all of monitors 100-1 through 100-M may be physically positioned in a row of monitors, or in some other physical arrangement. Or, monitors 100-1 through 100-M may be physically positioned in a two-dimensional grid of monitors. In some embodiments, processor 220 may receive a user-input parameter through a user interface 260. User interface 260 may take any form, for example a touchscreen, a video screen or lighted indicators with associated mechanical switches, or even one or more toggle switches with no indicators to input a pre-determined code that determines user settable operating parameters for driver 200. For example, user settable operating parameters may indicate the physical relationship between the monitors attached to monitor interface 250-1 through 250-M.

In some embodiments, user interface 260 may not be present, in which case driver 200 can be configured by outside source 202 through decoder/encoder 210. In some embodiments, driver 200 may default to an assumed monitor physical layout, for example all monitors aligned in one row or all monitors arranged in a two-dimensional rectangle.

The consolidated EDID data written into EDID memory 230 reflects the physical positioning of the monitors. Further, the consolidated EDID data written into EDID memory reflects the pixel sizes and the pixel speeds and dimensions of the individual ones of the monitors attached to monitor interfaces 250-1 through 250-M. Additionally, the consolidated EDID data can be written into EDID memory 230 in a standard format such as the VESA EDID format described above to be compatibly read by source 202 through decoder/encoder 210.

Figure 3:
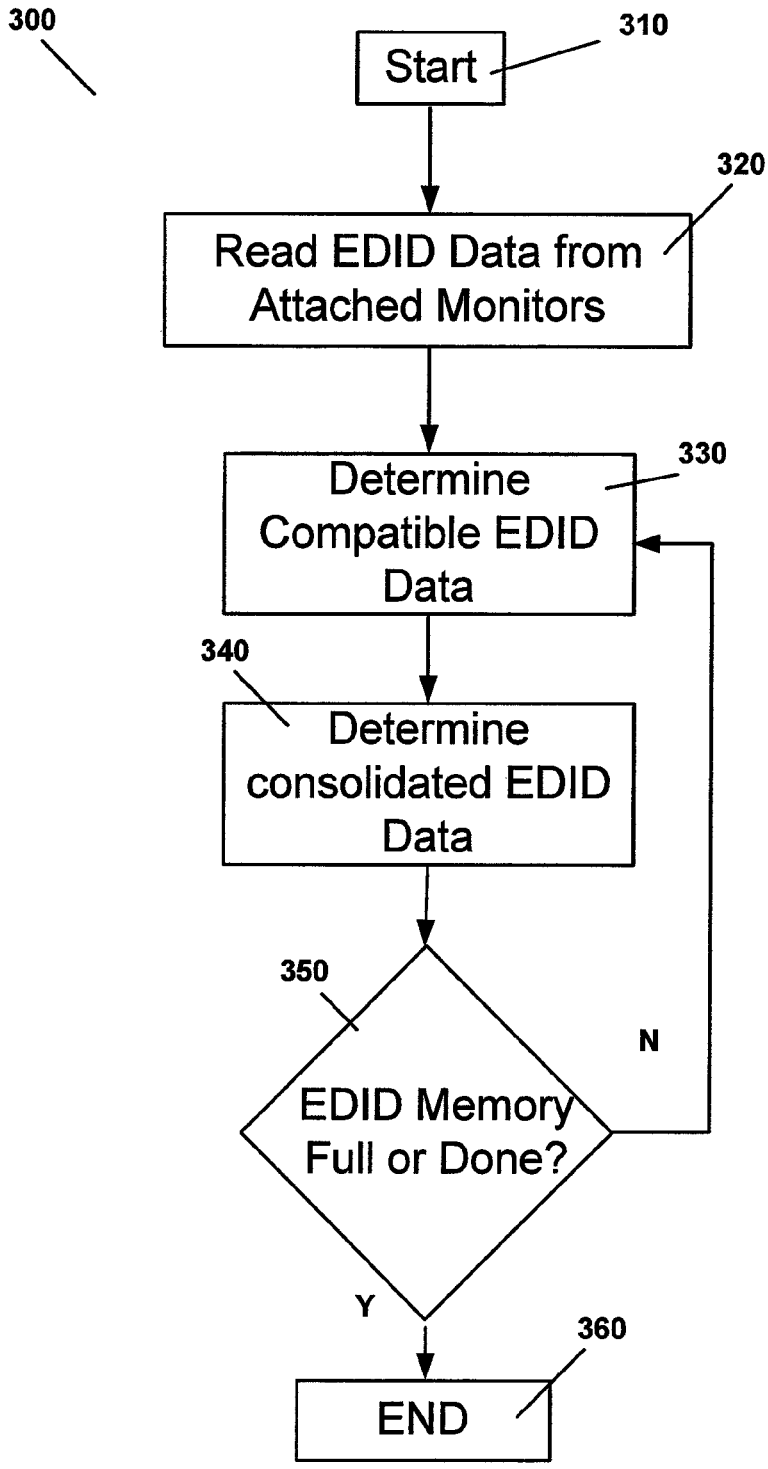
FIG. 3 illustrates a process for compiling EDID data according to some embodiments of the present invention.

FIG. 3 illustrates a flow chart of a process 300, executed by processor 220, for generating consolidated EDID data for storage in EDID memory 230. Process 300 can be indicated by program instructions stored in memory 240, which may be executed by processor 220. Start 310 is executed upon startup of driver 200 or when a new one of monitors 100-1 through 100-M is attached to driver 200. From start 310, process 300 proceeds to step 320. In step 320, the EDID data is read from each one of the attached monitors 100-1 through 100-M. In some embodiments, when a new monitor is attached to driver 200, only the EDID data from the new monitor is read. However, in some embodiments all of the monitors are read so that a full set of EDID data is obtained. In some embodiments, EDID data from each of the monitors may be stored in memory 240 for processing. Process 300 then proceeds to step 330.

In step 330, the EDID data for each of the monitors is compared to determine a set of operating parameters (e.g., pixel sizes and pixel timing) that is compatible between the monitors. When one is found, it is included in the consolidated EDID data that will be stored in EDID memory 230. In some embodiments, compatible operating parameters are those that are the same. In that case, step 330 determines a set of supported operating parameters that are common amongst all of monitors 100-1 through 100-M. In some embodiments, compatible operating parameters involve a determination of each monitor's physical size and pixel density so that compatible resolutions can be determined. Embodiments providing for various compatible relationships between individual sets of parameters can be implemented according to the present invention.

In step 340, a consolidated EDID data is provided that includes the compatible data found in step 330. Consolidated EDID data includes the EDID data formatted as described above. Individual EDID data for each of the monitors 100-1 through 100-M upon which the consolidated EDID data is based may also be stored in EDID memory 230. For example, in the case where all of the monitors are in a single row and a compatible EDID data is one where all have the same physical size, pixel dimensions, and timing, then the consolidated EDID data would have a horizontal dimension equal to M times the individual horizontal dimension, horizontal pixel dimension equal to M times the individual monitor pixel dimension, and vertical pixel dimension equal to the vertical pixel dimension of each of the monitors. In that case, the consolidated EDID data and the individual EDID data for each monitor may be stored.

When step 340 is completed, process 300 checks to see if EDID memory 230 is full or if all of the sets of operating parameters have been compared for compatibility in step 350. If not, then process 300 returns to step 330 to find another compatible set of operating parameters. If finished, process 300 ends at step 350.

After step 350, driver 200 can proceed to receive video data according to one of the sets of consolidated operating parameters in the consolidated EDID data selected by source 202. Driver 202 distributes data according to the corresponding individual sets of operating parameters for each of monitors 100-1 through 100-M that correspond to the consolidated operating parameters chosen by source 202.

In some embodiments, steps 320 and 330 may be combined so that, as the EDID data from each monitor is read, only the sets of parameters that are compatible are retained and incompatible sets are discarded. In that case, when the last monitor is read the compatible sets of data are already determined. Further, in some cases, when a new monitor is plugged into driver 200, its EDID data can be readily compared with the compatible sets stored with the consolidated EDID data instead of obtaining all of the individual EDID data from each monitor again.

Figure 4:
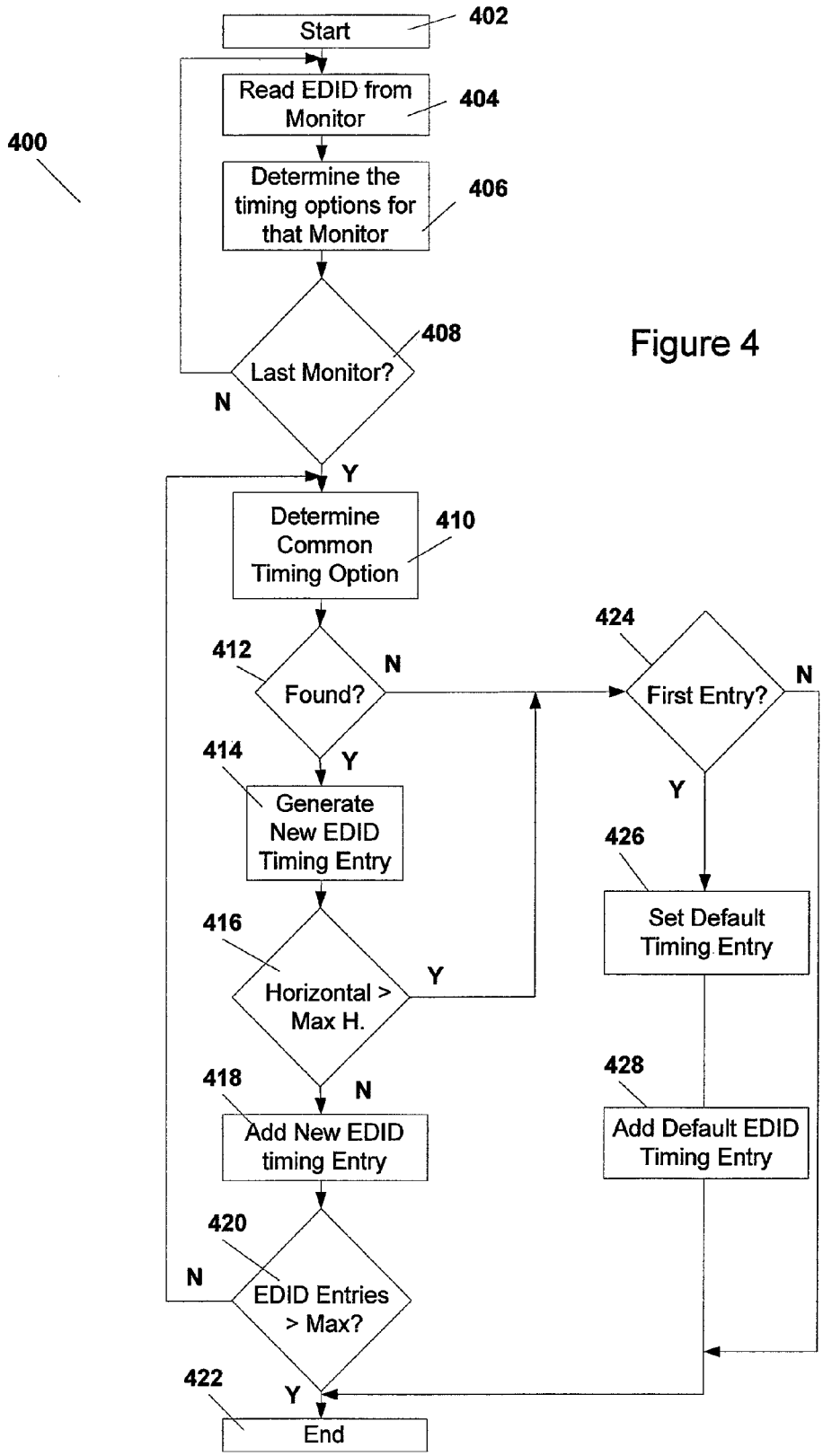
FIG. 4 illustrates a process for compiling EDID data according to some embodiments of the present invention.

FIG. 4 illustrates process 400, which is an example of process 300 in the case where the monitors are arranged in a single row and where compatible sets of operating parameters are determined when the operating parameters are common. As indicated, process 400 starts in step 402 when driver 200 is started or when a new monitor is plugged into driver 200. From step 402, process 400 proceeds to step 404 where EDID data is read from one of monitors 100-1 through 100-M. In step 406, the EDID data read in step 404 is analyzed to determine supported sets of operating parameters for that monitor. As indicated above, supported sets of operating parameters include determination of resolution and timings that are supported by that monitor. In step 408, process 400 determines whether all of monitors 100-1 through 100-M have been read. If not, then process 400 repeats steps 404 and 406 until the EDID data from all of the monitors have been read and the timing options for each of them determined. When the EDID data from all of monitors 100-1 through 100-M have been read, then process 400 proceeds to step 410.

In step 410, the timing options for each of monitors 100-1 through 100-M are compared for compatibility. In this embodiment, when a timing option that is common between all of monitors 100-1 through 100-M is determined or if no common timing parameter is found, the process 400 proceeds to step 412. In other embodiments, other standards for determining whether timing options are compatible may be utilized. In some embodiments, the first few timing options (for example the first eight) that are found can be set as the standard timing settings.

In step 412, if a new common timing option is found in step 410, then that timing entry is utilized to determine a consolidated timing entry in step 414. In particular, in the example where all of the monitors are arranged in a row, and there is a common timing option, the horizontal pixel resolution is set to M times the individual monitor pixel resolution and the vertical pixel resolution is set to the individual monitor pixel resolution. In the notation used above, the consolidated timing entry corresponds to (M*H Active) x V_active@Frame Frequency. Blanking information in the consolidated timing entry can be kept the same as in the common timing entry. The consolidated timing entry can be entered into the EDID data in the fashion described above to provide a VESA compatible EDID data that can be read by source 202.

In step 416, in some embodiments process 400 determines whether the consolidated timing entry is greater than an allowable limit. In some cases, the timing entry may be greater than the storage allocated for holding that parameter. For example, in the 18 byte detailed timing block described above, the horizontal resolution can be limited to 4096. In some embodiments, other limits may be checked to insure that the new consolidated timing entry falls within acceptable limits.

If the consolidated timing entry is acceptable, then it is added to the EDID data in step 418. In many cases, the timing entry is not a standard timing entry and therefore is added as an 18 byte detail timing block in the VESA EDID standard. Other standards may utilize a different formatting for a timing entry. In accordance with the standards set above, a limited number of 18 byte detail timing block entries can be made between the EDID block and the extension block. For example, in some embodiments up to nine detail timing block entries can be included, with three saved in the EDID base block and six saved in the EDID extension block. The timing entry in the first detailed timing block can be the preferred timing block for driver 200.

Once the new timing entry is added to the EDID data, then process 400 proceeds to step 420. In step 420, process 400 determines whether there is room for another timing entry. If not, the process ends in step 422 when the consolidated EDID data that has been compiled is written into EDID memory 230. If not, then process 400 returns to step 410 to determine if there is another possible timing entry that qualifies.

In step 412, if no further compatible timing entries are found in step 410 then process 400 proceeds to step 424. Additionally, if step 416 determines that one of the parameters has been exceeded, the process 400 proceeds to step 424. In step 424, if there are other timing entries already included in the EDID data, then process 400 ends in step 422. Otherwise, a default timing entry is determined in step 426. For example, the default timing entry can be set as 3840×V_Active@ Frame Frequency, where V_Active, the Frame Frequency, and the blanking information is chosen from a timing entry of one of the monitors. In step 428, the default timing entry is entered into the consolidated EDID data. Process 400 then ends in step 422.

The examples provided above are exemplary only and are not intended to be limiting. One skilled in the art may readily devise other multi-monitor systems consistent with embodiments of the present invention which are intended to be within the scope of this disclosure. As such, the application is limited only by the following claims.

TABLE 1

| Bytes | Data | Description |
|---|---|---|
| 0-7 | Header | Fixed: "00h FFh FFh FFh FFh FFh FFh 00h" |
| 8-9 | Manufacturer ID | Product Identification |
| 10-11 | Product ID code | |
| 12-15 | Serial Number | |
| 16-17 | Manufacture Date | |
| 18 | EDID Version # | EDID Version Information |
| 19 | EDID Revision # | |
| 20 | Video Input Type | Basic Display Parameters |
| 21 | Horizontal Size (cm) | |
| 22 | Vertical Size (cm) | |
| 23 | Display Gamma | |
| 24 | Supported Features | |
| 25-34 | Color Characteristics | Color Space Definition |
| 35-36 | Established Supported Timings | Timing information for all resolutions supported by the Monitor |
| 37 | Manufacturer's Reserved Timing | |
| 38-53 | EDID Standard Timings Supported | |
| 54-71 | Detailed Timing Descriptor (DTD) | |
| 72-89 | Detailed Timing Descriptor | |
| 90-107 | Detailed Timing Descriptor | |
| 108-125 | Detailed Timing Descriptor | |
| 126 | Extension Flag | Number of following EDID blocks |
| 127 | Checksum | |

TABLE 2

| Designation | Name | Aspect Ratio | Resolution/@freq. |
|---|---|---|---|
| 1 | DMT0659 | 4:3 | 640 × 480p @ 59.94/60 Hz |
| 2 | 480p | 4:3 | 720 × 480p @ 59.94/60 Hz |
| 3 | 480pH | 16:9 | 720 × 480p @ 59.94/60 Hz |
| 4 | 720p | 16:9 | 1280 × 720p @ 59.94/60 Hz |
| 5 | 1080i | 16:9 | 1920 × 1080i @ 59.94/60 Hz |
| 6 | 480i | 4:3 | 720(1440) × 480i @ 59.94/60 Hz |
| 7 | 480iH | 16:9 | 720(1440) × 480i @ 59.94/60 Hz |
| 8 | 240p | 4:3 | 720(1440) × 240p @ 59.94/60 Hz |
| 9 | 240pH | 16:9 | 720(1440) × 240p @ 59.94/60 Hz |
| 10 | 480i4x | 4:3 | (2880) × 480i @ 59.94/60 Hz |
| 11 | 480i4xH | 16:9 | (2880) × 480i @ 59.94/60 Hz |
| 12 | 240p4x | 4:3 | (2880) × 240p @ 59.94/60 Hz |
| 13 | 240p4xH | 16:9 | (2880) × 240p @ 59.94/60 Hz |
| 14 | 480p2x | 4:3 | 1440 × 480p @ 59.94/60 Hz |
| 15 | 480P2xH | 16:9 | 1440 × 480p @ 59.94/60 Hz |
| 16 | 1080p | 16:9 | 1920 × 1080p @ 59.94/60 Hz |
| 17 | 576p | 4:3 | 720 × 576p @ 50 Hz |

TABLE 2-continued

| Designation | Name | Aspect Ratio | Resolution/@freq. |
|---|---|---|---|
| 18 | 576pH | 16:9 | 720 × 576p @ 50 Hz |
| 19 | 720p50 | 16:9 | 1280 × 720p @ 50 Hz |
| 20 | 1080i25 | 16:9 | 1920 × 1080i @ 50 Hz |
| 21 | 576i | 4:3 | 720(1440) × 576i @ 50 Hz |
| 22 | 576iH | 16:9 | 720(1440) × 576i @ 50 Hz |
| 23 | 288p | 4:3 | 720(1440) × 288p @ 50 Hz |
| 24 | 288pH | 16:9 | 720(1440) × 288p @ 50 Hz |
| 25 | 576i4x | 4:3 | (2880) × 576i @ 50 Hz |
| 26 | 576i4xH | 16:9 | (2880) × 576i @ 50 Hz |
| 27 | 288p4x | 4:3 | (2880) × 288p @ 50 Hz |
| 28 | 288p4xH | 16:9 | (2880) × 288p @ 50 Hz |
| 29 | 576p2x | 4:3 | 1440 × 576p @ 50 Hz |
| 30 | 576p2xH | 16:9 | 1440 × 576p @ 50 Hz |
| 31 | 1080p50 | 16:9 | 1920 × 1080p @ 50 Hz |
| 32 | 1080p24 | 16:9 | 1920 × 1080p @ 23.98/24 Hz |
| 33 | 1080p25 | 16:9 | 1920 × 1080p @ 25 Hz |
| 34 | 1080p30 | 16:9 | 1920 × 1080p @ 29.97/30 Hz |
| 35 | 480p4x | 4:3 | (2880) × 480p @ 59.94/60 Hz |
| 36 | 480p4xH | 16:9 | (2880) × 480p @ 59.94/60 Hz |
| 37 | 576p4x | 4:3 | (2880) × 576p @ 50 Hz |
| 38 | 576p4xH | 16:9 | (2880) × 576p @ 50 Hz |
| 39 | 1080i25 | 16:9 | 1920 × 1080i(1250 Total) @ 50 Hz |
| 40 | 1080i50 | 16:9 | 1920 × 1080i @ 100 Hz |
| 41 | 720p100 | 16:9 | 1280 × 720p @ 100 Hz |
| 42 | 576p100 | 4:3 | 720 × 576p @ 100 Hz |
| 43 | 576p100H | 16:9 | 720 × 576p @ 100 Hz |
| 44 | 576i50 | 4:3 | 720(1440) × 576i @ 100 Hz |
| 45 | 576i50H | 16:9 | 720(1440) × 576i @ 100 Hz |
| 46 | 1080i60 | 16:9 | 1920 × 10801 @ 119.88/120 Hz |
| 47 | 720p120 | 16:9 | 1280 × 720p @ 119.88/120 Hz |
| 48 | 480p119 | 4:3 | 720 × 480p @ 119.88/120 Hz |
| 49 | 480p119H | 16:9 | 720 × 480p @ 119.88/120 Hz |
| 50 | 480i59 | 4:3 | 720(1440) × 480i @ 119.88/120 Hz |
| 51 | 480i59H | 16:9 | 720(1440) × 480i @ 119.88/120 Hz |
| 52 | 576p200 | 4:3 | 720 × 576p @ 200Hz |
| 53 | 576p200H | 16:9 | 720 × 576p @ 200Hz |
| 54 | 576i100 | 4:3 | 720(1440) × 576i @ 200 Hz |
| 55 | 576i100H | 16:9 | 720(1440) × 576i @ 200 Hz |
| 56 | 480p239 | 4:3 | 720 × 480p @ 239.76/240 Hz |
| 57 | 480p239H | 16:9 | 720 × 480p @ 239.76/240 Hz |
| 58 | 480i119 | 4:3 | 720(1440) × 480i @ 239.76/240 Hz |
| 59 | 480i119H | 16:9 | 720(1440) × 480i @ 239.76/240 Hz |
| 60 | 720p24 | 16:9 | 1280 × 720p @ 23.98/24 Hz |
| 61 | 720p25 | 16:9 | 1280 × 720p @ 25 Hz |
| 62 | 720p30 | 16:9 | 1280 × 720p @ 29.97/30 Hz |
| 63 | 1080p120 | 16:9 | 1920 × 1080 @ 119.88/120 Hz |

We claim:

1. A multi-monitor driver, comprising:

a processor coupled to an EDID memory;

one or more monitor interfaces coupled to the processor;

wherein the processor is configured to:

read Extended Display Identification Data (EDID) from one or more monitors coupled to the one or more monitor interfaces;

determine compatible EDID data based on the EDID data read from the one or more monitors;

determine a consolidated EDID data based on the EDID data from the one or more monitors and the compatible EDID data, the consolidated EDID data being synthesized from the compatible EDID;

determine whether at least one parameter in the consolidated EDID data is greater than an allowable limit;

write parameters of the consolidated EDID data into the EDID memory that are determined to not be greater than an allowable limit; and write default parameters into the EDID memory for parameters of the consolidated EDID data that are greater than an allowable limit.

2. The multi-monitor driver of claim 1, further including a source interface coupled to the processor and wherein the processor provides the consolidated EDID data stored in the EDID memory to an outside source through the source interface.

3. The multi-monitor driver of claim 1, wherein the consolidated EDID data comprises a consolidated timing option.

4. The multi-monitor driver of claim 3, wherein the consolidated timing option depends on a physical arrangement of the one or more monitors.

5. The multi-monitor driver of claim 4, wherein the physical arrangement of the one or more monitors is the one or more monitors placed in a row.

6. The multi-monitor driver of claim 4, wherein the physical arrangement of the one or more monitors is a two-dimensional placement of the one or more monitors.

7. The multi-monitor driver of claim 4, wherein the processor receives information regarding the physical arrangement of the one or more monitors from a source coupled to the processor through a source interface.

8. The multi-monitor driver of claim 4, wherein the processor receives information regarding the physical arrangement of the one or more monitors through a user interface coupled to the processor.

9. The multi-monitor driver of claim 1, wherein the compatible EDID data comprises EDID data that is the same for all of the one or more monitors from which the EDID is read.

10. A method of providing Extended Display Identification Data (EDID), comprising:

reading EDID data from one or more monitors through one or more monitor interfaces;

determining a compatible timing option among the EDID data for the one or more monitors;

determining a consolidated timing option based on the compatible timing option;

determining whether the consolidated timing option is greater than an allowable limit;

storing a consolidated EDID data that includes the consolidated timing option in an EDID memory if the consolidated timing option is not greater than an allowable limit;

and storing a consolidated EDID data that includes a default timing option if the consolidated timing option is greater than an allowable limit; the consolidated EDID data being synthesized from the EDID data.

11. The method of claim 10, wherein determining a compatible timing option includes determining one or more individual timing options from each of the EDID data for the one or more monitors;

comparing the one or more individual timing options from each of the EDID data to detect a common timing option amongst all of the one or more monitors;

setting the compatible timing option to the common timing option.

12. The method of claim 10, wherein determining the consolidated timing option includes calculating the consolidated timing option based on the compatible timing option and a physical arrangement of the one or more monitors.

13. The method of claim 12, wherein the physical arrangement is a row of the one or more monitors, and wherein the compatible timing option is a common timing option, and calculating the consolidated timing option includes setting a consolidated horizontal pixel resolution to a number of the one or more monitors times a horizontal pixel resolution of the common timing option;

setting a consolidated vertical pixel resolution to a vertical pixel resolution of the common timing option; and setting blanking data to a blanking data from the common timing option.

14. The method of claim 12, further including reading an indication of the physical arrangement from a user interface.

15. The method of claim 12, further including reading an indication of the physical arrangement from a source.

16. The method of claim 10, further including providing the EDID data from the EDID memory to a source.

* * * * *